United States Patent [19]

Kiricoples et al.

[11] Patent Number: 4,536,099

[45] Date of Patent: Aug. 20, 1985

[54] WRITING INSTRUMENT WITH BALL POINT AND TWO RESERVOIRS

[75] Inventors: Charles P. Kiricoples, Salem; Henry Behrens, Topsfield; Robert L. Brown, Hingham, all of Mass.

[73] Assignee: The Gillette Company, Boston, Mass.

[21] Appl. No.: 550,075

[22] Filed: Nov. 8, 1983

[51] Int. Cl.[3] ..... B43K 7/00; B43K 7/08

[52] U.S. Cl. ..... 401/209; 401/151; 401/210; 401/217; 401/230

[58] Field of Search ..... 401/217, 210, 209, 230, 401/151

[56] References Cited

U.S. PATENT DOCUMENTS

| | | | |
|---|---|---|---|
| 2,883,969 | 4/1959 | Sams | 401/217 X |

FOREIGN PATENT DOCUMENTS

| | | | |
|---|---|---|---|
| 133570 | 7/1949 | Australia | 401/217 |
| 459666 | 9/1949 | Canada | 401/230 |
| 632001 | 12/1961 | Canada | 401/230 |
| 806331 | 6/1951 | Fed. Rep. of Germany | 401/217 |
| 933412 | 4/1948 | France | 401/217 |
| 1028424 | 5/1953 | France | 401/217 |
| 1063299 | 4/1954 | France | 401/217 |

*Primary Examiner*—Steven A. Bratlie

*Attorney, Agent, or Firm*—Leonard J. Janowski

[57] ABSTRACT

A ball-point writing instrument in which dislodging of the rotating ball as a result of accidental droppage on a hard surface is prevented by employing an ink reservoir construction designed to prevent propagation of a travelling pressure step in the column of ink above the rotating ball.

14 Claims, 6 Drawing Figures

WRITING INSTRUMENT WITH BALL POINT AND TWO RESERVOIRS

BACKGROUND OF THE INVENTION

It is a long-standing product requirement of rotating ball writing instruments such as the common ball-point pen that such instruments be capable of withstanding the effects of being dropped upon a hard surface such as a concrete or tile floor without damage to the instrument which would impair its writing quality. Where such writing instruments employ viscous inks or a wick or fiber-filled ink reservoir to contain less viscous inks, the problem has been relatively easy to overcome. Where, however, it is desired to use a writing instrument employing an ink of lesser viscosity such as water-based ink in a reservoir not employing a wick or fibrous absorbing member, accidental droppage can often render the writing instrument non-functional because the rotating ball will become dislodged from its socket even though the point and ball are not directly contacted by the hard surface. This is especially a problem when plastic points are used since such points usually have a ball retention force not exceeding about 0.3 pounds as compared to metal points which usually have a retention force ranging from 0.7 to 3.8 pounds. No satisfactory explanation has existed of the system kenetics leading to such ball loss.

We have made many attempts including design changes of the ball seat configuration, internal restricting of the barrel and modification of ink and grease plug follower properties to prevent such ball loss when using plastic points or other points having a low-ball retention force. While some degree of success has been achieved, none has made possible the passing of a test in which such a writing instrument is dropped upon a hard surface from a distance of three feet, simulating accidental dropping by the user.

We have analogized the phenomenon causing ball loss to that of water hammer in household pipes. This occurs when a valve is suddenly closed causing the water in the pipe to stop flowing with an abrupt increase in pressure. In order that the flowing water be brought to rest, it is necessary for the kinetic energy of the water to be transformed into potential energy and stored in available energy sinks. Energy can be stored by a compression of the water and by an expansion of the pipe walls, both due to an increase in water pressure.

The physics of a writing instrument impacting on a solid surface can be considered analogous to that of water hammer with the only difference being that the pen barrel, i.e. the pipe, is moving with the ink, i.e. the water.

Specifically, for the pen-ink system, as the ball is stopped during impact, the following series of events occur:

The first ink layer behind the ball becomes compressed due to its kinetic energy and comes to rest at an above-normal pressure. This increase in ink pressure causes the pen wall just behind the ball to expand thereby experiencing strain. As the second layer comes up against the first, it is also compressed and comes to rest at the same above-normal pressure, and again causes strain of the corresponding section of the pen wall. As each succeeding layer of ink comes to rest, the process of ink compressing and wall straining continues up the length of the ink column. Physically, the process can be described as a pressure wave, actually a travelling pressure step, originating at the ball and moving toward the air/ink interface causing each succeeding layer of ink to come to rest.

As the last layer of ink compresses, the total kinetic energy of the ink is transformed into potential energy and is stored in the elastic deformations of stationary compressed ink and strained pen walls. This point of pressure wave action will be defined as the end of the first of four periods of wave motion.

As soon as the last layer of ink is fully compressed as the air/ink interface, the process reverses and the stored potential energy causes each successive layer to move backwards toward the air/ink interface, analogous to the action that occurs when a compressed spring is released. As the potential energy is decreased, the pressure within each ink layer and the strain within the corresponding section of the pen wall is returned to normal, i.e. zero, until the wave front reaches the ball again and the entire system has returned to normal pressure. But at the end of this period of wave action, the entire ink column is moving away from the ball with the same kinetic energy, neglecting losses, as before impact. This is the end of the second period of wave action.

During the third period, with the initial velocity of the total ink column away from the ball, the kinetic energy of each layer, starting at the ball, will be transformed into potential energy by a lowering of ink pressure to a below normal level with an attendant contraction of the corresponding pen walls.

As the process continues, the pressure wave propagates toward the air/ink interface until the system energy is stored in stationary ink, pressurized below normal, and in negatively strained pen walls. This is the end of the third period of wave action.

With the pressure in the stationary ink now below normal, the first layer of ink at the air/ink interface starts moving toward the ball. As the wave progresses, the stored potential energy is released by successive layers until the ink regains its normal pressure and initial velocity and the entire ink column is moving toward the ball as it was just before impact. This ends the fourth period.

Repeating cycles of four periods follow, but each has diminished energy because of dissipative forces within the ink/pen wall system.

The entire procedure can be viewed as a travelling pressure step originating at the ball and moving up and down the ink reservoir reflecting off of the air/ink interface reversed in sense and reflecting off of the solid ball surface unchanged in sense.

The salient feature of this analysis is centered around the end of the second period of pressure traverse. At this point, the pressure increase on the ball drops to zero, and subsequently, during the third period the pressure increase is negative (below normal pressure).

The consequence of this is that, if the ball has not moved a sufficient distance to be dislodged from its socket by the end of the second period, then it will be retained during the impact because the pressure on the ball will have been reduced below a level sufficient to continue dislodgement.

We have shown by experimentation that ball loss as a result of the effects of the travelling pressure step described above can be eliminated if the column of ink in the pen barrel above the ball is kept sufficiently short. Unfortunately, when using plastic points, many of which may have a retention force as low as 0.1 pound or less, we found that ball loss would often occur even if the column of ink above the ball did not exceed one inch in height. Because such a small quantity of ink would unduly restrict the writing life of a pen, the expedient of simply limiting the ink to fill level is not an adequate solution to the problem.

SUMMARY OF THE INVENTION

We have discovered that dislodging of the rotating ball from a ball-point writing instrument employing a plastic point, or other point having a low-ball retention force, as a consequence of dropping can be prevented by employing an ink reservoir construction in which the height of the column of ink above the ball does not exceed a critical column height, which is determined by system variables including ink density and bulk modulus, pen barrel wall thickness and modulus of elasticity, barrel diameter, point socket holding length, and the radius and weight of the ball. This is accomplished by employing a construction comprising separate ink reservoirs in fluid communication, one of which contains a fluid-gas interface.

DESCRIPTION OF PREFERRED EMBODIMENTS

Figure 1:
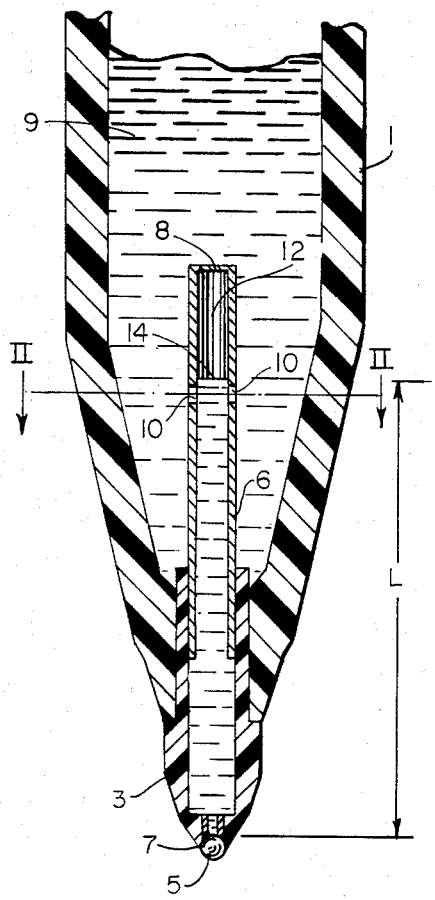
FIG. 1 is a longitudinal axial section through the forward portion of a writing instrument including the essential components of this invention.
Figure 2:
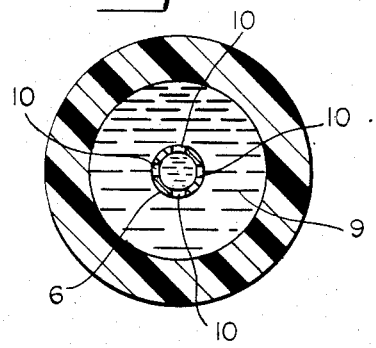
FIG. 2 is a cross-sectional elevational view of the writing instrument taken on line II—II of FIG. 1.

As shown in FIGS. 1 and 2 of the drawings, the writing instrument comprises a tubular barrel portion 1 acting as a first ink reservoir and having an opening at its lower end for receiving and frictionally engaging a writing tip 3 adapted to rotatably hold ball 5 in ball socket 7. Contained within barrel portion 1 is an ink 9 suitable for use with ball-point writing instruments. Contained within barrel portion 1 and acting as a second ink reservoir is plastic tube 6 sealed at its upper end by end wall 8 and open to surrounding ink 9 in barrel portion 1 by way of holes 10. Contained within the upper portion of plastic tube 6 is a bubble of air or other non-reactive gas 12, the location of which is critical to the fluid dynamic behavior of the ink-filled writing instrument when it is dropped against a hard surface. This critical longitudinal distance between the gas-ink interface 14 and ball 5 is shown in FIG. 1 as distance L, referred to hereinafter as the critical liquid column height (CLCH).

The critical liquid column height is a function of a number of variables and fixed constants. For purposes of this invention, the critical liquid column height is defined as that distance which the pressure step in the ink must traverse twice within the time necessary for the ball to leave the socket, under the action of the pressure step. We have determined that this maximum distance between the gas-ink interface and rotating ball for any pen-ink system is approximated by the following relationship:

$$CLCH = \frac{V_s}{2}\sqrt{\frac{2 \times ShL \times \frac{\text{ball weight}}{g}}{\left[\left(\frac{e}{g}\right)(\sqrt{2gh})(V_s)(\pi r^2) - F_{ret.\,min.}\right]}}$$

$$\text{where } V_s = \sqrt{\frac{E_I}{\frac{e}{g}} \; \frac{1}{1 + \frac{2R}{t}\left(\frac{E_I}{E\text{ wall}}\right)}}$$

g=acceleration of gravity (i.e. 386 inches/sec.$^2$)
e=ink density (pounds/inch$^3$)
t=pen barrel wall thickness (inches)
2R=wall diameter (inches)
h=drop height (inches)
($\sqrt{2gh}$)=impact velocity (inches/sec.)
$E_I$=bulk modulus of ink (pounds/inch$^2$)
ShL=socket holding length (i.e. the allowable axial movement of the ball within the ball socket without dislodgment, in inches)
r=radius of the ball (inches)
ball weight=weight of rotatable ball (pounds)
E wall=modulus of elasticity of pen barrel wall (pounds/inch$^2$)
$F_{ret.\,min.}$=minimum point retention force (pounds)

Thus, for any given writing instrument system in which the available point has a given minimum point retention force, the maximum CLCH which can be employed without risking dislodgement of the ball upon dropping from any given distance can be determined by the defined interrelationship of the variables comprising (1) the ink density and bulk modulus, (2) the pen barrel wall thickness and modulus of elasticity, (3) ball radius and weight, and (4) point socket holding length.

When one employs values for the above variables inherent in typical pen constructions and ink compositions, the CLCH will be found to range from about 0.36 to 0.62 inch for a drop height of 36 inches and using plastic points having a ball retention force ranging from about 0.077 pounds to 0.288 pounds respectively. Most such systems will have a CLCH of no more than 0.75 inch although it can range up to 2 inches where the system employs an ink of unusually high bulk modulus.

While the pen construction shown in FIGS. 1 and 2 exemplifies the principle of CLCH critical to the practice of the invention, alternative constructions having advantages in ease of manufacture are shown in FIGS. 3 through 6. In these embodiments a closed cell foam member is used in place of an air bubble to provide the effect of a fluid-gas interface and to separate the point ink supply from the body of the ink.

Figure 3:
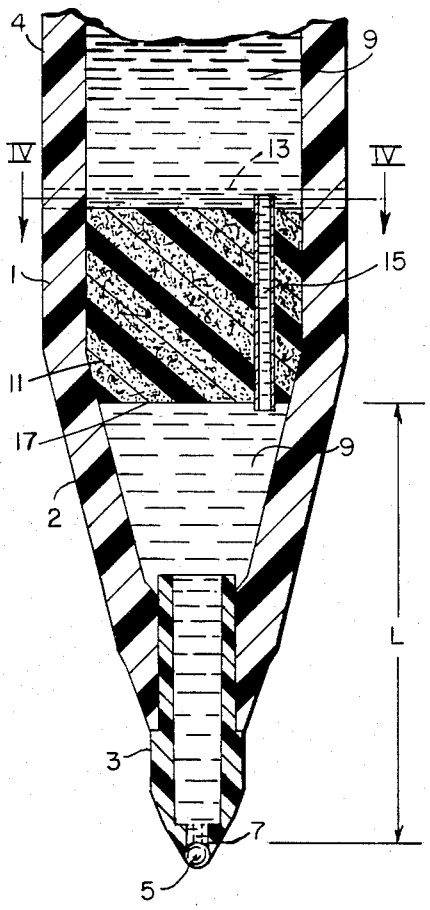
FIG. 3 is a longitudinal axial section through the forward portion of a writing instrument showing another embodiment of the essential components of this invention.
Figure 4:
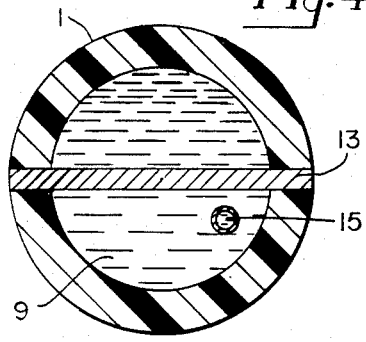
FIG. 4 is a cross-sectional elevation view of the writing instrument taken along line IV—IV of FIG. 3.

Referring to FIGS. 3 and 4, there is located within barrel portion 1 and fitting snugly against its circular inner wall a closed cell foam member 11 which acts as a gas-ink interface with respect to the propagation of any travelling pressure step originating at the ball as a result of the writing instrument striking a hard surface upon being dropped. The longitudinal distance between the lower surface of the foam member and rotatable ball 5 is critical and is maintained through the action of staking wire 13 or by other suitable means such as by adhesively bonding it to the inner circular wall of barrel portion 1. To permit the replenishment of ink in lower barrel portion 2 as it is used up during writing, there is provided ink feed tube 15 which provides liquid communication between the ink reservoir formed by lower barrel portion 2 and the ink reservoir formed by upper barrel portion 4. While the inside diameter of ink feed tube 15 should be large enough to permit the required flow of ink from upper barrel portion 4 to lower barrel portion 2, it should not be so large as to permit the propagation of a pressure wave of sufficient magnitude to cause ball 5 to be dislodged from ball socket 7 should the writing instrument be accidentally dropped. We have found that the inside diameter of ink-feed tube 15 may be as small as 0.010 inch and still feed sufficient ink to the ball without causing starvation.

To maximize the volume of ink contained in lower and upper barrel portions 2 and 4, it is desirable to minimize the longitudinal thickness of foam member 11 consistent with its function in acting as an gas-ink interface. While this minimum thickness is related to some extent to the inside diameter of barrel portion 1 and the characteristics of the foam material employed, as will be hereinafter discussed, we have found that a thickness ranging from about $\frac{1}{4}$ to $\frac{3}{4}$ inch may be used.

Most important is the distance L between surface 17 of foam member 11 and ball 5. If this distance L exceeds the critical liquid column height, then the travelling pressure step will have a tendency to return to the ball socket area after the ball has been dislodged resulting in a non-functional writing instrument due to accidental dropping.

Figure 5:
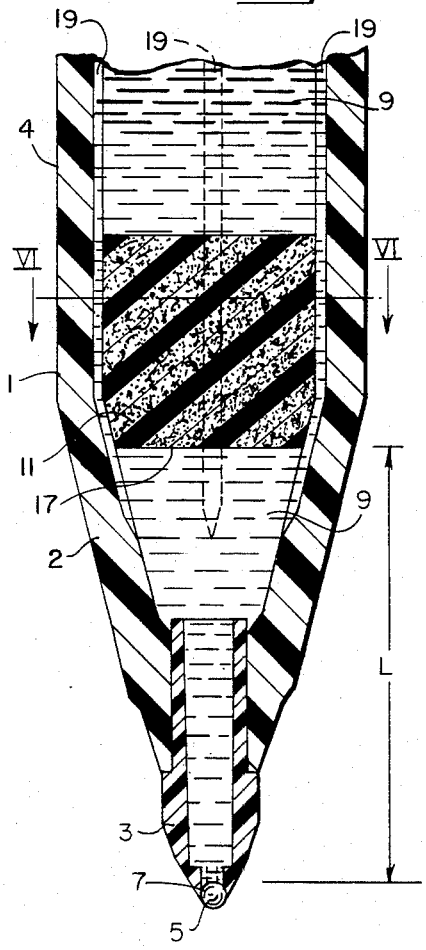
FIG. 5 is a longitudinal axial section through the forward portion of a writing instrument showing yet another embodiment of the essential components of this invention.
Figure 6:
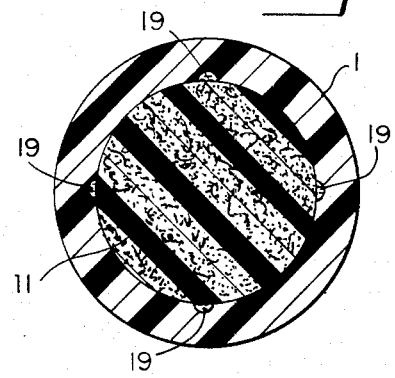
FIG. 6 is a cross-sectional elevational view of the writing instrument taken along line VI—VI of FIG. 5.

An alternative construction is shown in FIGS. 5 and 6 in which ink feed tube 15 is replaced by ink feed channels or grooves 19 which serve the same function, i.e. to permit the passage of liquid ink from upper barrel portion 4 to lower barrel portion 2 in response to ink usage as a result of writing instrument use. While the embodiment shown in FIGS. 3 and 4 employs four such ink-feed grooves, any number may be employed as long as the total cross-sectional area of the grooves does not substantially exceed that required to provide a steady supply of ink to ball 5.

We have described some embodiments of our invention employing a bubble of air as the effective gas-ink interface and others in which the gas-ink interface comprises a closed cell foam material. It should be appreciated that the gas bubble (or balloon, or air bag) and the closed cell foam material are the equivalent of each other for use in any embodiment since the foam can be thought of as an assembly of small gas bubbles or bags.

Conventional materials of construction well known to the writing instrument industry may be employed in the construction of the barrel and writing tip elements of the writing instrument of this invention. For the purpose of minimizing cost, barrel portion 1 may be made by the injection molding of plastic materials such as polypropylene, polystyrene, and ABS(acylonitrile-butadiene-styrene). Writing tip 3 is preferably constructed of any suitable plastic with the preferred plastic material being acetal, either homopolymer or copolymer. Rotatable ball 5 may be made of stainless steel, carbide, or any of the other materials known to be useful in the production of rotating ball writing instruments.

As has been mentioned hereinabove, it is important that foam member 11 be a closed cell foam to enable it to act as an gas-ink interface. We have found that a variety of foam densities and pore sizes may be employed with equal efficacy as long as the foam is not able to absorb the ink in the manner of a sponge. Materials which may be employed include epichlorohydrin, nitrile, and neoprene foams having a density ranging from about 5 to about 20 pounds/ft.$^3$.

Staking wire 13, which prevents the longitudinal movement of foam member 11 may be made from stainless steel or other material which will not react with ink 9. In like manner ink feed tube 15 may be constructed from any non-reactive material although we prefer to use tubing made from polypropylene.

In the embodiment shown in FIGS. 3 and 4, the use of staking wire 13 is omitted by securing the surface of foam member 11 to the inner walls of barrel portion 1 by using any conventional adhesive which will not be dissolved by or reactive with the ink.

I claim:

1. A writing instrument comprising a tubular barrel in association with a writing tip having a rotatably mounted ball, said writing instrument having ink-filled first and second ink reservoirs in fluid communication with each other, the ink in said second ink reservoir also being in fluid communication with said ball and forming a liquid-gas interface with a body of gas contained in said second ink reservoir, the longitudinal distance between the liquid-gas interface and the rotatably mounted ball not exceeding the critical liquid column height for the writing instrument where the critical liquid column height (CLCH) has the following definition:

$$CLCH = \frac{V_s}{2}\sqrt{\frac{2 \times ShL \times \frac{\text{ball weight}}{g}}{\left[\left(\frac{e}{g}\right)(\sqrt{2gh})(V_s)(\pi r^2) - F_{ret.\,min.}\right]}}$$

$$\text{where } V_s = \sqrt{\frac{E_I}{\frac{e}{g}} \; \frac{1}{1 + \frac{2R}{t}\left(\frac{E_I^2}{E\,\text{wall}}\right)}}$$

g=acceleration of gravity (i.e. 386 inches/seconds$^2$)
e=ink density (pounds/inch$^3$)
t=pen barrel wall thickness (inches)
2R=wall diameter (inches)
h=drop height (inches)
($\sqrt{2gh}$)=impact velocity (inches/sec.)
$E_I$=bulk modulus of ink (pounds/inch$^2$)
ShL=socket holding length (i.e. the allowable axial movement of the ball within the ball socket without dislodgment, in inches)
r=radius of the ball (inches)
ball weight=weight of rotatable ball (pounds)
E wall=modulus of elasticity of pen barrel wall (pounds/inch$^2$) and
$F_{ret.\,min.}$=minimum point retention force (pounds).

2. A writing instrument as described in claim 1 in which the longitudinal distance between the liquid-gas interface and the rotatably mounted ball does not exceed 0.75 inch.

3. A writing instrument comprising a tubular barrel in association with a writing tip having a rotatably mounted ball, said tubular barrel having an upper barrel portion and a lower barrel portion which are in fluid communication and which are separated by a member providing the effect of a liquid-gas interface, the longitudinal distance between the surface of said member providing the effect of a liquid-gas interface and the rotatably mounted ball not exceeding the critical liquid column height for the writing instrument where the critical liquid column height (CLCH) has the following definition:

$$CLCH = \frac{V_s}{2}\sqrt{\frac{2 \times ShL \times \frac{\text{ball weight}}{g}}{\left[\left(\frac{e}{g}\right)(\sqrt{2gh})(V_s)(\pi r^2) - F_{ret.\,min.}\right]}}$$

$$\text{where } V_s = \sqrt{\frac{E_I}{\frac{e}{g}}\;\frac{1}{1 + \frac{2R}{t}\left(\frac{E_I}{E\text{ wall}}\right)}}$$

g=acceleration of gravity (i.e. 386 inches/seconds$^2$)
e=ink density (pounds/inch$^3$)
t=pen barrel wall thickness (inches)
2R=wall diameter (inches)
h=drop height (inches)
($\sqrt{2gh}$)=impact velocity (inches/sec.)
$E_I$=bulk modulus of ink (pounds/inch$^2$)
ShL=socket holding length (i.e. the allowable axial movement of the ball within the ball socket without dislodgment, in inches)
r=radius of the ball (inches)
ball weight=weight of rotatable ball (pounds)
E wall=modulus of elasticity of pen barrel wall (pounds/inch$^2$) and
$F_{ret.\,min.}$=minimum point retention force (pounds).

4. A writing instrument as described in claim 3 in which the means for fluid communication comprise an ink-feed tube.

5. A writing instrument as described in claim 3 in which the means for fluid communication comprise an ink-feed channel.

6. A writing instrument as described in claim 3 in which the longitudinal distance between the member providing the effect of a liquid-gas interface and the rotatably mounted ball does not exceed 0.75 inch.

7. A writing instrument comprising a tubular barrel in association with a writing tip having a rotatably mounted ball, said tubular barrel having an upper barrel portion and a lower barrel portion which are in fluid communication and which are separated by a member of closed cell foam, the longitudinal distance between a surface of said foam member and the rotatably mounted ball not exceeding the critical liquid column height for the writing instrument where the critical liquid column height (CLCH) has the following definition:

$$CLCH = \frac{V_s}{2}\sqrt{\frac{2 \times ShL \times \frac{\text{ball weight}}{g}}{\left[\left(\frac{e}{g}\right)(\sqrt{2gh})(V_s)(\pi r^2) - F_{ret.\,min.}\right]}}$$

$$\text{where } V_s = \sqrt{\frac{E_I}{\frac{e}{g}}\;\frac{1}{1 + \frac{2R}{t}\left(\frac{E_I}{E\text{ wall}}\right)}}$$

g=acceleration of gravity (i.e. 386 inches/seconds$^2$)
e=ink density (pounds/inch$^3$)
t=pen barrel wall thickness (inches)
2R=wall diameter (inches)
h=drop height (inches)
($\sqrt{2gh}$)=impact velocity (inches/sec.)
$E_I$=bulk modulus of ink (pounds/inch$^2$)
ShL=socket holding length (i.e. the allowable axial movement of the ball within the ball socket without dislodgment, in inches)
r=radius of the ball (inches)
ball weight=weight of rotatable ball (pounds)
E wall=modulus of elasticity of pen barrel wall (pounds/inch$^2$) and
$F_{ret.\,min.}$=minimum point retention force (pounds).

8. A writing instrument as described in claim 7 in which there is provided a means for fluid communication between the upper and lower barrel portions.

9. A writing instrument as described in claim 8 in which the means for fluid communication comprises an ink-feed tube.

10. A writing instrument as described in claim 8 in which the means for fluid communication comprises an ink-feed channel.

11. A writing instrument as described in claim 7 in which the longitudinal distance between the foam member and the rotatably mounted ball does not exceed 0.75 inch.

12. A writing instrument as described in claim 7 in which the position of the foam member with respect to the rotatably mounted ball is maintained by the action of a staking wire.

13. A writing instrument as described in claim 7 in which the position of the foam member with respect to the rotatably mounted ball is maintained by adhesively bonding the foam member to the tubular member.

14. A writing instrument as described in claim 7 in which the foam member has a longitudinal thickness of at least 0.125 inch.

* * * * *